United States Patent [19]

Smeets

[11] Patent Number: 4,463,334

[45] Date of Patent: Jul. 31, 1984

[54] ELECTRIC COIL ON CORE WITH ANGLED END SURFACE

[75] Inventor: Frans H. M. Smeets, Eindhoven, Netherlands

[73] Assignee: U.S. Philips Corporation, New York, N.Y.

[21] Appl. No.: 400,824

[22] Filed: Jul. 22, 1982

[30] Foreign Application Priority Data

Jul. 30, 1981 [NL] Netherlands ..... 8103601

[51] Int. Cl.[3] ..... H01F 15/10; H01F 27/30

[52] U.S. Cl. ..... 336/192; 336/65; 336/208; 336/221

[58] Field of Search ..... 336/221, 65, 192, 198, 336/208, 220, 184

[56] References Cited

U.S. PATENT DOCUMENTS

| | | | |
|---|---|---|---|
| 3,500,274 | 3/1970 | Matsuuna et al. | 336/65 |
| 3,585,553 | 6/1971 | Muckelroy et al. | 336/192 |
| 3,593,217 | 7/1971 | Weber | 336/221 X |
| 3,711,805 | 1/1973 | Heijnen et al. | 336/65 |
| 4,314,221 | 2/1982 | Satou et al. | 336/192 X |

FOREIGN PATENT DOCUMENTS

| | | | |
|---|---|---|---|
| 1145280 | 3/1963 | Fed. Rep. of Germany | 336/83 |
| 1564556 | 7/1969 | Fed. Rep. of Germany | 336/83 |

*Primary Examiner*—Thomas J. Kozma

*Attorney, Agent, or Firm*—Thomas A. Briody; William J. Streeter

[57] ABSTRACT

The coil comprises a coil former with a rod-shaped central core portion (1) and two end portions (3,5) wherebetween a winding (13) made of a conductor (15) is provided. No part of the coil projects beyond a first boundary plane which contains an outer surface (25) of the first end portion (3) and preferably also a contact surface (21, 23) and which encloses an angle of between 5° and 85° with respect to the axis (11) of the rod-shaped central portion. The mutual coupling of two or such coils can be very readily varied by mounting the coils in the same position or rotated through 90° or 180° with respect to respect to each other on a substrate (27).

7 Claims, 8 Drawing Figures

ELECTRIC COIL ON CORE WITH ANGLED END SURFACE

The invention relates to an electric coil with a coil former which comprises a rod-shaped central core portion and at each of the extremities thereof an end portion which comprises an inner surface which faces the central portion and which extends approximately perpendicularly to the axis of the central portion, there being situated between said inner surfaces a winding which is made of an electric conductor whose ends are anchored to anchor points on the first one of the two end portions.

The end portions of known coils of this kind (for example, see German Auslegeschrift No. 22 29 859) are shaped as discs which extend perpendicularly to the axis of the central portion and on which there are provided protrusions with anchor points. These coils are intended to be mounted on a flat substrate, for example, a printed circuit board or a hybrid circuit. The position of the coil with respect to the substrate is determined by the location of the protrusions. Generally, these protrusions are situated so that the axis of the rod-shaped central portion of the coil base for a given type of coil always extends either perpendicular to the plane of the substrate or parallel to this plane (for example, see German Offenlegungsschrift No. 1,815,479). Consequently, when two coils of the same type are mounted in the vicinity of one another, the axes of their central portions will generally be mutually parallel, so that the coils exhibit a comparatively high mutual coupling. In many cases such coupling is detrimental to the operation of the circuit in which the coils are incorporated. In other cases such coupling is desirable, but the degree of coupling of the coils must often have a predetermined value. Even though the coupling between two parallel arranged coils can be gradually reduced by situating the coils further apart, more space will then be required and the circuit will be more expensive. It is also possible to minimize the coupling between two coils which are situated near one another by using different types of coils, i.e. a coil whose axis extends perpendicularly to the board and a second coil whose axis extends parallel to the board. The use of different types of coils in one circuit, however, is also comparatively expensive and, moreover, makes the circuit less suitable for automatic mounting techniques. A third method of influencing the coupling between two coils is to mount coils with their axes parallel to the board so that their axes enclose a predetermined angle of between 0° and 90° . In that case, the tool which positions the coils on the board must rotate one of these coils through a corresponding angle; this necessitates the use of more complex tools. Moreover, the freedom of the designer as regards the choice of the lay-out of the conductor tracks and the situation of the solder points on the substrate is then restricted considerably.

It is an object of the invention to provide a coil of the kind set forth which can be coupled to a second coil of the same type in different manners by the mounting of the second coil in the same position as the first coil or rotated through 90° or 180° with respect to the first coil, so that the tool merely must be capable of positioning the coils in a limited number of standardized positions.

To this end, the coil in accordance with the invention is characterized in that no part of the coil projects beyond a first boundary plane which contains an outer surface of the first end portion and which encloses an angle of more than 5° and less than 85° with respect to the axis of the rod-shaped central portion.

When two such coils are then mounted adjacent one another, their axes may be parallel (maximum coupling) or may enclose an angle with respect to one another which is determined by the position of the axis with respect to the first boundary plane.

The electrical connection between the coil and a conductor track present on the substrate can be very simply realized in a preferred embodiment of the coil in accordance with the invention which is characterized in that the first boundary plane contains at least one contact surface which is electrically connected to one of the anchor points.

A further preferred embodiment of the coil in accordance with the invention is characterized in that diametrically opposite the first boundary plane there is situated a second boundary plane beyond which no part of the coil projects, said second boundary plane containing an outer surface of the second of the two end portions and being parallel to the first boundary plane. This makes it particularly easy to place the coil in the correct position on the substrate by means of, for example, a vacuum pipette.

Some embodiments of the invention will be described in detail hereinafter with reference to the drawing. Therein:

Figure 1:
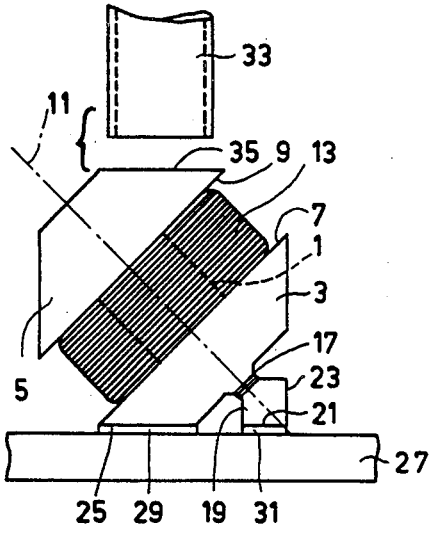
FIG. 1 is a side elevation of a first embodiment of an electric coil in accordance with the invention.
Figure 2:
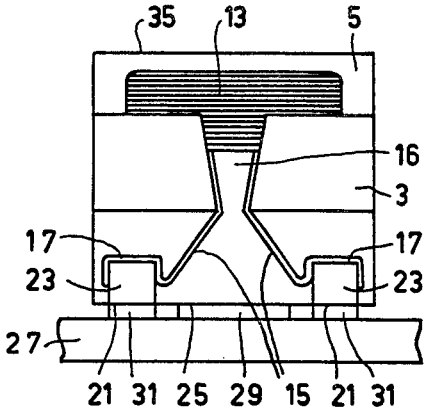
FIG. 2 is a front view of the coil shown in FIG. 1.

The electric coil shown in the FIGS. 1 and 2 comprises a coil former with a rod-shaped central core portion 1 (denoted by broken lines in FIG. 1) and an end portion 3, 5 at each of the extremities thereof. Each of the end portions 3, 5 has an inner surface 7, 9, respectively, which faces the central portion 1 and which makes an angle of approximately 90° with respect to the axis 11 of the central portion (denoted by a stroke/dot line). On the central portion 1 a winding 13 is arranged between the two inner surfaces 7, 9 said winding being made of an electric conductor 15, for example, copper wire. The ends of the conductor 15 pass through a groove 16 in the first end portion 3 and are anchored to anchor points 17 formed on the first end portion. Each of these anchor points is situated on a constriction which forms the transition between the end portion 3 and a contact base 19 which comprises two contact surfaces 21, 23. These contact surfaces are metallized and are electrically connected to the ends of the conductor 15, for example, by a soldered connection. The coil base, consisting of the central portion 1, the two end portions 3, 5 and the contact bases 19, is preferably made as an integral unit of ferrite.

The contact surfaces 21 which are directed downwards in the FIGS. 1 and 2 are situated in the same plane as an outer surface 25 of the first end portion 3 which also faces downwards. The plane defined by the contact faces 21 and the outer surface 25 constitutes a first bounding plane of the coil beyond which no part of the coil projects. As a result, the coil can be positioned by way of the contact surfaces 21 and the outer surface 25 on a flat substrate such as a board 27 with surface wiring. The outer surface 25 is connected to the board 27 by means of a layer of glue 29 for mechanical connection and the contact surfaces 21 are electrically and mechanically connected to conductor tracks on the board (not shown) via soldered connections 31. The first boundary plane in which the contact surfaces 21 and the outer surface 25 are situated encloses an angle of 45° with the axis of the central portion 1, so that this axis encloses the same angle with the surface of the board 27.

In order to enable automatic mounting of the coil on the board 27, it is desirable that the coil can be picked up and displaced, for example, by means of a vacuum pipette 33. To this end, diametrically opposite the first boundary plane, i.e. at the top of the coil in the FIGS. 1 and 2, there is situated a second boundary plane beyond which no part of the coil projects and which contains an outer surface 35 of the second end portion 5. This outer surface 35 of the second end portion 5 is parallel to the outer surface 25 of the first end portion 3, so that the second boundary plane is also parallel to the first boundary plane.

Figure 3:
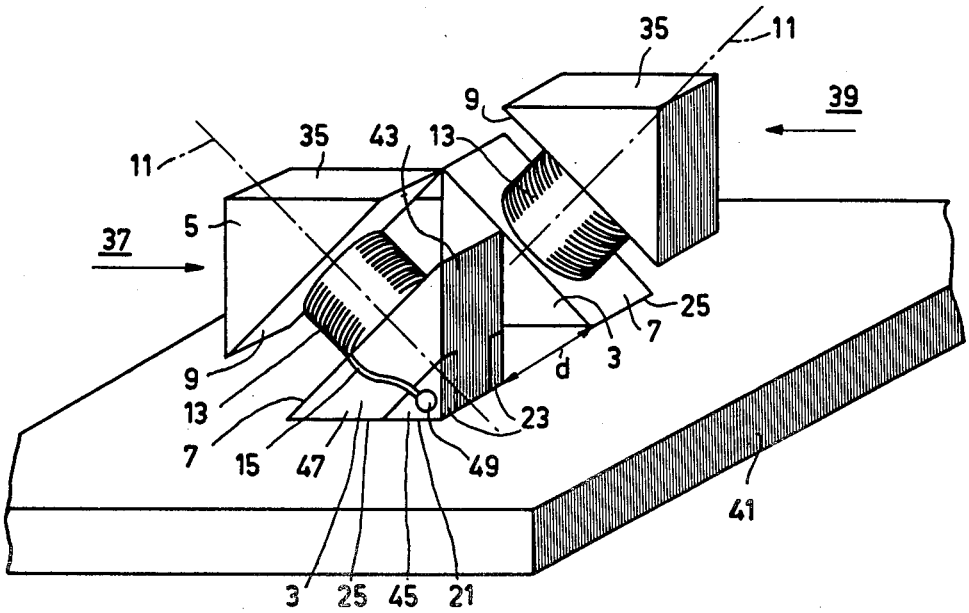
FIG. 3 is a perspective view of a substrate on which two coils according to a second embodiment are mounted.

FIG. 3 is a perspective view of two coils 37 and 39 which are mounted on a substrate 41, for example, a board comprising surface wiring. Each of the coils 37 and 39 comprises, like the coil shown in the FIGS. 1 and 2, a coil base of ferrite with a first end portion 3 and a second end portion 5 wherebetween a central core portion (not visible) with a winding 13 is arranged. The two end portions comprise inner surfaces 7 and 9, respectively, which face the central portion and which bound the winding 13. Furthermore, the first end portion 3 has an outer surface 25 which is situated in a first boundary plane and which encloses an angle of 45° with respect to the axis 11 of the central portion. The second end portion 5 comprises an outer surface 35 which is situated in a second boundary plane which is parallel to the first boundary plane. Thus far, the coils 37 and 39 fully correspond to the coil shown in the FIGS. 1 and 2.

Contact surfaces 21 are not provided on a contact base 19 in this embodiment, but rather on parts of the outer surface 25 of the first end portion 3 which face the substrate 41. On a second outer surface 43 of this end portion, being perpendicular to the first outer surface 25 and also enclosing an angle of 45° with respect to the axis 11 of the central portion, there are provided contact surfaces 23. These metallized contact surfaces are electrically connected to metallized portions 45 of a third outer surface 47 of the first end portion 3 which constitute anchor portions for the ends of the conductor 15 used to form the winding 13. These ends are electrically and mechanically connected to the anchor points 45 by means of soldered connections 49. The connection between the contact surfaces 21 and the conductor tracks (not shown) on the substrate 41 can also be realized by means of soldering, or, for example, by means of an electrically conductive glue. Separate connection of the coils to the substrate, such as by means of the layer of glue 29 in FIGS. 1 and 2, is usually superfluous. On the other hand, the anchoring to the flat anchor points 45 is more complex and more time consuming than the anchoring to the anchor points 17 formed by constrictions. It depends on the circumstances which embodiment is to be preferred in a given case.

The coil 37 is mounted so that the axis 11 points to the left and the coil 39 is mounted therebehind in a position rotated through 180°, so that its axis 11 points to the right. Because both axes 11 enclose an angle of 45° with respect to the upper surface of the substrate 41, they mutually enclose an angle of 90°. This means that the magnetic stray field of the front coil 37 cannot effectively penetrate into the rear coil 39 and vice versa. Therefore, the two coils are not coupled to any extent, even when their spacing d is very small.

If mutually coupling of the coils is desirable, for example, the rear coil 39 can be mounted in the same direction as the front coil 37, so that the two axes 11 extend parallel to each other. The degree of coupling then depends on the distance d so that it can be chosen in advance. When the windings 13 of the two coils are connected in series, comparatively high inductances can be realized. When two coils having the same inductance are electrically connected in parallel, the power handling becomes approximately twice that of a single coil. High loads can thus be handled by a number of small coils. In the case of series connection as well as in the case of parallel connection of two or more coils, the total inductance of the combination depends on the degree of coupling between the coils. A further application of two strongly coupled coils is the manufacture of a transformer in which the front coil 37 constitutes the primary winding and the rear coil 39 constitutes the secondary winding.

If desirable, the rear coil 39 may alternatively be mounted to be rotated through 90° with respect to the front coil 37. The axes 11 of the two coils then enclose an angle of between 0° and 90° with respect to one another (60°), so that the mutual coupling also has an intermediate value.

In FIG. 3, the first coil 37 is arranged in front of the second coil 39, so that their axes 11 are not situated in one plane when they extend perpendicularly to one another. It is alternatively possible to mount the second coil 39 to the right of the first coil 37, so that the axes 11 are in the same plane when they are mutually perpendicular. The position of the second coil 39 with respect to the first coil 37 then again determines whether the coupling of the coils is almost nill, median or maximum.

Figure 4A:
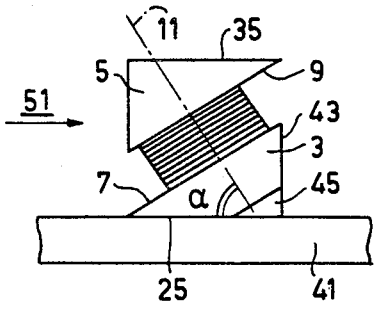
FIGS. 4A–E are a side elevation of a number of possibilities for mounting a third embodiment of the coil in accordance with the invention.

FIG. 4A is a side elevation of a third embodiment of a coil in accordance with the invention. The construction of this coil 51 is essentially the same as that of the coils 37 and 39 of FIG. 3 and the same reference numerals are used for corresponding parts. However, the difference consists in that the axis 11 of the central portion of the coil 51 encloses an angle $\alpha$ of 60° with respect to the first boundary plane which contains the first outer surface 25 of the first end portion 3. The second outer surface 43 of this end portion, being perpendicular to the first outer surface 25, then encloses an angle of 30° with respect to the axis 11. This second outer surface defines a third boundary plane beyond which no part of the coil projects. This third boundary plane, therefore, extends perpendicularly to the first boundary plane and the angle enclosed thereby with respect to the axis 11 is the complement of the angle $\alpha$ between the axis and the first boundary plane. A third boundary plane of this kind is also present in the coils 37 and 39 and also in the coil shown in the FIGS. 1 and 2 in which it contains the contact surfaces 23. Because the angle between the first boundary plane and the axis 11 equals 45° in those cases, the complement of this angle (the angle between the third boundary plane and the axis) also equals 45°. Therefore, it does not make an essential difference whether these coils are mounted so that the first or the third boundary plane faces the substrate 41 or 27. However, in the case of the coil 51 the angle between the axes 11 of these two coils can be influenced not only by rotating one of the coils through 90° or 180° about its vertical axis, but also by tilting one of the coils through 90° about its horizontal axis. The consequences of the latter possibility will be briefly described with reference to the FIGS. 4B to 4E. Each of these Figures shows a side elevation of a coil 53 which is similar to the coil 51. It is assumed that the coil 53 is mounted on the substrate 41 in front of the coil 51, so that the FIGS. 4B to 4E must also be assumed to be situated in front of FIG. 4A. The arrangement of the two coils 51, 53 is then comparable to that of the two coils 37, 39 in FIG. 3.

Figure 4B:
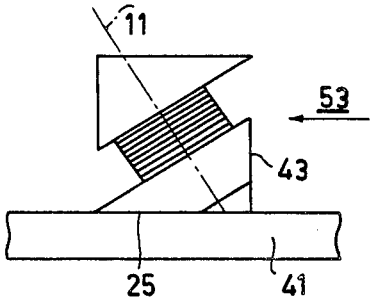

The coil 53 shown in FIG. 4B is mounted in the same position as the coil 51, so that their axes 11 are mutually parallel and their mutual coupling is maximum.

Figure 4C:
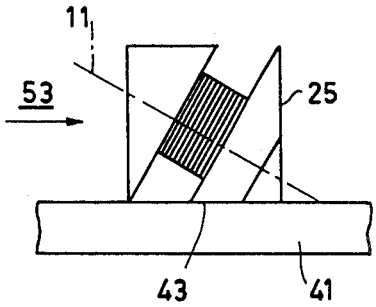
Figure 4D:
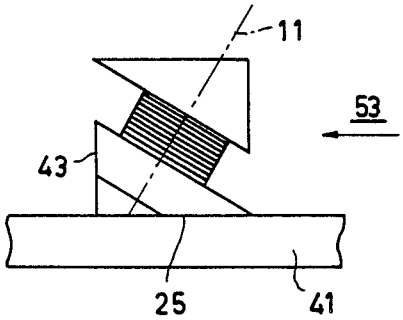
Figure 4E:
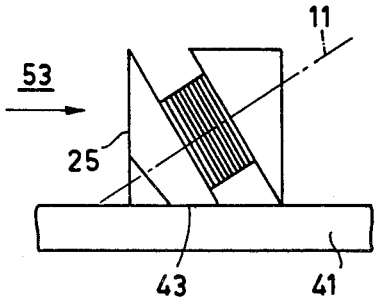

FIG. 4C shows the coil 53 mounted so that its second outer surface 43 faces the substrate 41, the coil having been rotated so that the axis 11 points to the left. The axis 11 of the coil 53 then encloses an angle of 30° with respect to the substrate 41 and hence also an angle of 30° with respect to the axis of the coil 51. For the same mutual distance, the coupling between the two coils is then slightly less than in the arrangement shown in FIG. 4B.

The coil 53 in FIG. 4D is again mounted so that its first outer surface 25 faces the substrate 41, but it has been rotated through 180° about the vertical axis with respect to the situation shown in FIG. 4B. The axis 11 of the coil 53 then encloses an angle of 120° with respect to the substrate 41 and the angle between the axes 11 of the two coils 51 and 53 is 60°. The coupling between the coils, therefore, is again less than in the arrangement shown in FIG. 4C.

The coil 53 in FIG. 4E is again mounted so that the second outer surface 43 faces the substrate 41, but in comparison with FIG. 4C it has been rotated through 180° about its vertical axis, so that the axis 11 now points to the right and encloses an angle of 150° with respect to the substrate 41. The angle of this axis with respect to the axis 11 of the coil 51 is 90° and the coupling between the two coils is minimum.

From the description of the FIGS. 4A to 4E it thus appears that the mutual coupling between the coils can be controlled in several steps by very simple variations of the location of the coils which can be very readily performed by automatic equipment. The number of steps can in this case be increased by taking into account not only the rotation through 180° about the vertical axis, but also a rotation through 90° about this axis. The number of possibilities is further increased by mounting coils also on the other principal surface of the substrate 41 (the lower surface in FIG. 4) or by arranging two substrates one against the other by way of their principal surfaces which do not accommodate coils.

In the described embodiments, the angle between the axis 11 and the first boundary plane is 30° or 45°, for which it must be taken into account that an angle of 30° is equivalent to an angle of 60°, because no difference exists between the first and the third boundary plane. Other series of feasible mutual couplings can be realized by the selection of other angles; it is desirable that these angles are between 5° and 85°, because otherwise a rotation through 180° about the vertical axis has only a negligibly small influence on the coupling between the coils. Evidently, it is also possible to arrange two or more coils with different angles between the axis 1 and the first boundary plane on a substrate.

What is claimed is:

1. In an electric coil assembly including a rod-shaped central core portion, first and second core end portions at opposite ends respectively of said central portion, the end portions having inner surfaces facing said central portion that are substantially perpendicular to the axis of said central portion, a coil of an electric conductor on said central portion, and first and second conductive anchor points on said first end portion and connected to opposite ends of said coil, said anchor points being positioned to be soldered to a printed circuit board; the improvement wherein said first end portion has a first end surface in a plane at an angle from 5 degrees to 85 degrees with respect to the axis of said central portion, all of said coil assembly being on one side of the plane of said first end surface, said first end surface having contact surfaces electrically connected to said anchor points.

2. The electric coil assembly of claim 1 wherein said second end portion has an end surface lying in a plane parallel to the plane of said first end portion, said coil assembly being entirely on one side of said plane of said end surface of said second end portion.

3. The electric coil assembly of claim 2 wherein said first end surface is in a plane at 45 degrees to said axis.

4. The electric coil assembly of claim 9 wherein the plane of said first end surface is at an angle of 60 degrees to said axis.

5. The electric coil assembly of claim 2 wherein the plane of said first end surface is at an angle of 30 degrees to the axis of said central portion.

6. The coil assembly of claim 1 wherein said first end portion has a second end surface in a plane at an angle to said axis that is the complement of the angle between the plane of said first end surface and said axis, said coil assembly being entirely on one side of the plane of said second end surface.

7. The electric coil assembly of claim 1 wherein said first end portion includes a second end surface in the plane of said first end surface and separated therefrom by a constriction of said first end portion, said second end surface being closer to the respective inner surface than said first end surface, said second end surface being substantially free of contact portions connected to said coil.

* * * * *

UNITED STATES PATENT AND TRADEMARK OFFICE

CERTIFICATE OF CORRECTION

PATENT NO. : 4,463,334

DATED : 7/31/84

INVENTOR(S) : FRANS H.M. SMEETS

It is certified that error appears in the above-identified patent and that said Letters Patent is hereby corrected as shown below:

Column 6, Claim 4, line 1, "claim 9" should be --claim 2--.

Signed and Sealed this

*Twenty-fifth* Day of *December 1984*

[SEAL]

*Attest:*

GERALD J. MOSSINGHOFF

*Attesting Officer*

*Commissioner of Patents and Trademarks*